US006364119B1

(12) United States Patent
Graham

(10) Patent No.: US 6,364,119 B1
(45) **Date of Patent: *Apr. 2, 2002**

(54) SCREENING DEVICE AND APPARATUS INCLUDING SAME

(76) Inventor: Neil Deryck Bray Graham, 18 Castelon Crescent, Cockburn Waters, Western Australia (AU)

( * ) Notice: Subject to any disclaimer, the term of this patent is extended or adjusted under 35 U.S.C. 154(b) by 0 days.

This patent is subject to a terminal disclaimer.

(21) Appl. No.: 09/643,169

(22) Filed: Aug. 21, 2000

Related U.S. Application Data

(63) Continuation of application No. 08/894,774, filed as application No. PCT/AU96/00106 on Feb. 28, 1995, now Pat. No. 6,126,016.

(30) Foreign Application Priority Data

Feb. 28, 1995 (AU) ..... PN1408
Mar. 23, 1995 (AU) ..... PN1971

(51) Int. Cl.[7] ..... B07B 1/52; E02F 9/26

(52) U.S. Cl. ..... 209/385; 209/389; 37/308; 37/318; 299/9

(58) Field of Search ..... 209/264, 379, 209/385, 386, 389, 390; 37/308, 317, 318; 299/7, 8, 9

(56) References Cited

U.S. PATENT DOCUMENTS

| | | | | |
|---|---|---|---|---|
| 1,584,277 A | | 3/1926 | Dec | 37/341 X |
| 3,761,132 A | | 9/1973 | Grable | 209/44 X |
| 3,790,213 A | | 2/1974 | Grable | 175/58 X |
| 3,917,326 A | | 11/1975 | Grable | 299/8 |
| 4,277,339 A | | 7/1981 | Quin | 209/389 X |
| 4,368,923 A | | 1/1983 | Handa | 299/8 |
| 4,497,519 A | | 2/1985 | Grable | 299/8 |
| 4,521,305 A | | 6/1985 | Deal | 37/57 X |
| 4,574,501 A | | 3/1986 | Sloan | 37/58 |
| 4,585,274 A | | 4/1986 | Grable | 299/7 |
| 4,826,251 A | | 5/1989 | Balkus | 299/7 |
| 5,072,991 A | | 12/1991 | Rohr | 299/9 |
| 5,133,852 A | | 7/1992 | Wark | 241/81 X |
| 6,126,016 A | * | 10/2000 | Graham | 209/385 |

FOREIGN PATENT DOCUMENTS

| | | | |
|---|---|---|---|
| AU | B-63696/80 | 5/1981 | |
| AU | A-29620/89 | 8/1989 | |
| DE | 2839932 A1 | 4/1980 | |
| DE | 2952215 A1 | 7/1981 | |
| DE | 3524650 A1 | 1/1987 | |
| DE | 3607457 A1 | 9/1987 | |
| DE | 3823863 A1 | 12/1989 | |
| FR | 2 669 094 | 6/1994 | |
| GB | 2276573 | 10/1994 | 209/389 |
| WO | WO 89/05200 | 6/1989 | |
| WO | WO 92/10312 | 6/1992 | |
| WO | WO 92/17646 | 10/1992 | |

* cited by examiner

*Primary Examiner*—Tuan N. Nguyen
(74) *Attorney, Agent, or Firm*—Hogan & Hartson, LLP

(57) ABSTRACT

A screening device including a screen having a first side for presentation to material to be screened and a second side, a plurality of screen openings in the screen extending between the first and second side thereof, a plurality of tines mounted on a support device disposed on the second side of the screen, each tine being moveable in a first direction along a path at least part of which includes one of the screen openings whereby the tine is receivable in and moveable along the screen opening, the tine extending beyond the first side of the screen for at least part of the movement thereof along the screen opening, the tines being moveably mounted on the support device for deflection away from said first direction while continuing to move in said first direction upon encountering an obstruction.

19 Claims, 16 Drawing Sheets

SCREENING DEVICE AND APPARATUS INCLUDING SAME

RELATED APPLICATION

The present application is a continuation application of U.S. patent application Ser. No. 08/894,774, U.S. Pat. No. 6,126,016, a national filing of PCT/AU96/00106 filed Feb. 28, 1995, which claims priority of Australia Patent Application Nos. PN 1408 and PN 1971 filed Feb. 28, 1995 and Mar. 23, 1995, respectively.

TECHNICAL FIELD

This invention relates to a screening device and to apparatus employing such a screening device. The invention also relates to a method of recovering material from an underground location.

BACKGROUND TO THE INVENTION

Screens are used for separating aggregate material according to size. One common form of screen is a grizzly which comprises a set of parallel bars in spaced apart relationship to provide elongate screen openings. In some situations, the screen openings in grizzlys can become clogged by material obstructing the openings. The obstructing material may be trapped in the screen openings or may simply accumulate on the intake side of the screen openings.

The present invention seeks to provide a screening device which has a screen and provision to remove obstructing material from screen openings within the screen.

The screening device according to the invention has particular application in the recovery of material from an underground location. In such an application, the screening device may be incorporated in a recovery head operable underground. Indeed, the recovery head incorporating the screening device may form part of an underground mining apparatus which has been devised particularly, although not necessarily exclusively, for mining in normally inaccessible locations including underground land-based formations such as deep leads, and deep marine alluvial deposits.

A deep lead typically comprises an ancient river valley through which an underground stream flows through an aquifer which contains metallic particles or heavy minerals below an overburden containing mud, sand and in some cases basalt. The metallic particles and/or heavy minerals in the stream bed are concentrated in the lower regions of sand and that part of the bedrock which has corroded to form a deposit known as "wash". The wash may be of irregular composition, comprising a combination of sand, mud, and rocks and boulders of various sizes. To efficiently recover the metallic particles and/or heavy minerals, only wash material should be removed. Removal of wash material does, however, present considerable difficulties owing to its irregular composition and the uneven nature of the bedrock beneath it. It is the presence of the rocks and boulders in the wash material which presents a particular difficulty.

The inaccessible nature of the formation and in particular the depth underground as well as the irregular composition of the wash material precludes mining by way of a conventional dredging process.

Similarly, marine deposits may be too deep for conventional mining operations.

The present invention also seeks to provide a novel and useful system for recovering materials from underground locations.

SUMMARY OF THE INVENTION

According to one aspect of the invention there is provided a screening device comprising a screen having a first side for presentation to a body of material to be screened and a second side, a plurality of elongate screen openings in the screen extending between the first and second sides thereof, a plurality of tines mounted on support means disposed on the second side of the screen, each tine being movable along a path at least part of which includes one of the elongate screen openings whereby the tine is receivable in and movable along the elongate screen opening, the tine extending beyond the first side of the screen for at least part of the movement thereof along the screen opening.

The tines may serve one or more of various functions. A common function of the tines may be to clear obstructions from the screen openings to prevent clogging thereof of the screen openings. The obstructions may include obstructing material temporarily trapped in the screen openings and obstructing material accumulating on the first side of the screen. The tines serve to dislodge the trapped obstructing material or to move the obstructing material across the first face and out of the way of the screen openings.

Another function of the tines may be to fracture solid matter in the vicinity of the screening device. The solid matter may comprise rocks or other lumps of matter including a mass of consolidated material such as a deposit of clay. The action of the tines fractures the solid matter so that fragments thereof can either pass through the screen openings or be moved clear of the screen openings by the tines.

Still another function of the tines may be to provide traction to the apparatus in which the screening device according to the invention is fitted. Where such apparatus is required to move through a body of material such as an underground formation, the tines may engage the formation to provide traction to the apparatus.

Still another function of the tines may be to assist in creation of a slurry on the first side of the screen.

Still another function of the tines may be to agitate slurry material that has passed through the screen to maintain solids in suspension in the slurry.

Preferably, the support means is adapted to move each tine along a cyclical path. As each tine moves along the cyclical path, it may enter the respective screen opening from the second side of the screen, move along the screen opening, and then withdraw from the screen opening on the second side of the screen.

The support means for the tines may comprise a closed loop structure adapted for cyclical movement. The closed loop structure may include an endless chain or belt passing around end rollers, or a rotating drum. In this way, the tines are moved through the cyclical path, a part of which takes each tine along a respective one of the screen openings. Alternative arrangements for moving each tine through the cyclical path may comprise a fluid ram system, a walking beam mechanism or a lag and cam mechanism.

In one arrangement, a drive means may be provided for driving the closed loop structure for cyclical movement thereof. The drive means may comprise a hydraulic motor.

In another arrangement, the closed loop structure may be caused to move cyclically under the influence of the body of material acting on the tines.

The tines may be movably supported on the support means so as to be capable of deflection upon encountering an unmanagable obstruction such as a large boulder which can neither be moved nor fragmented. This allows the tines to pass the unmanagable obstruction without damage.

The tines may be resiliently movable on the support means so as to be yieldingly resist such deflection and to return to the undeflected condition after moving clear of the unmanagable obstruction.

In one arrangement, the screen may comprise a grizzly.

In another arrangement, the screen may comprise a wedge-wire screen. Such a screen includes supporting cross-members extending transversely of the wires. The cross-members span the screen openings and so provide obstructions to movement of the tines therealong. The tines must therefore be movably supported on the support means so as to be capable of deflection to pass the cross-members. For this purpose, each tine may comprise one of a set of tines mounted in a radial arrangement about an axis of rotation transverse to the cyclical path of movement of the set of tines. Each set of tines is arranged for step-by-step rotation so that upon one tine in the set encountering one of the cross-members, or indeed some other immovable obstruction, the set of tines is caused to rotate thereby deflecting the tine rearwardly to pass the obstructing cross-member. As the tine deflects, the set of tines indexes to position another one of the tines in the screen opening.

Sets of tines may be positioned in banks which extend across the screen. The various sets of tines in each bank may be mounted on a common hub which indexes the sets of tines in unison.

The screening device according to the first aspect of the invention has particular application in the recovery of material from an underground location. In such an application, the screening device may be incorporated in a recovery head according to a second aspect of the invention. The recovery head may be used for recovery of material from underground for various purposes such as mining operations, and tunnelling or other excavation operations. The recovery head comprises a body adapted for movement through an underground formation, a chamber provided within the body into which material to be recovered can enter after passing through the screen device and from where such material can be conveyed to a remote location.

Material entering the chamber of the recovery head is conveniently in the form of a slurry, the screen regulating the maximum size of solids within the slurry. The slurry is particularly convenient as it can be conveyed to a remote location, such as a ground surface, by a suction or pumping operation.

A conveying means may be provided for conveying the recovered material from the recovery head to the remote location.

The conveying means may comprise a pipe system extending between the recovery head and the remote location for conveyance of the recovered material. This is particularly suitable in circumstances where the recovered material is conveyed in a slurry form. The pipe system may be in the form of a pipe string.

In circumstances where the recovered material is not in slurry form, the conveying means may comprise a belt conveyor.

The pipe string may also be employed to deliver replacement material from the remote location to the underground zone. Alternatively, a separate pipe string or the like may be provided for such purpose. The replacement material is provided for replacing at least a portion of the material recovered from the underground zone.

The body of the recovery head may have a frontal surface which is tapered upwardly and rearwardly with respect to the normal direction of forward travel of the recovery head and which is presented to oncoming material as the recovery head advances through the underground zone. The screening device is preferably located in or otherwise associated with the frontal surface.

The slurry is preferably formed by agitating the mixture of solid materials and water present in the underground zone at which the recovery operation is taking place. It may be necessary to fragment consolidated materials, and in particular clay, in the underground zone in order to form the slurry and also allow the recovery head to move through the zone.

The introduction of water, preferably at high pressure, into the zone may also assist in formation of the slurry or indeed to form the slurry in circumstances where the underground stream is inactive.

The recovery head may also have means for disturbing the slurry in order to maintain heavy particles in suspension in the slurry. Such means may comprise means for vibrating the recovery head or at least a part thereof to agitate the slurry.

The frontal surface of the recovery head may define a leading edge at the lower end thereof which provides a blade to facilitate passage of the recovery head through the underground zone.

The recovery head may also have a re arward surface which tapers downwardly and rearwardly to a trailing edge. The trailing edge may provide a blade which facilitates passage of the recovery head through the underground zone on movement of the recovery head in the reverse direction. The rearward surface may have a second screening device according to the invention located in or otherwise associated with it.

The recovery head may have an upper surface extending between the frontal and rearward surfaces. The upper surface may also have a third screening device according to the invention located in or otherwise associated with it.

The tines of one or more of the various screening devices incorporated in the recovery head may provide traction for propelling the recovery head through the underground zone.

Means may be provided for discharging water under pressure into the region below the recovery head to establish a layer of water which provides a fluid cushion for providing support to the recovery head and thereby assisting its movement through the underground zone. Alternatively, an endless track may be provided on the underside of the recovery head to assist movement thereof through the underground zone. Similar endless tracks may be provided on side walls of the recovery head.

The recovery head may be provided with a control system incorporating sensors and controls for continuously observing and actively controlling all aspects of the underground mining operation. Such controls may include navigational controls, radiation sensors, and detection devices for detecting the structure of the deposit in which the recovery head is operating and in particular identifying and locating precious materials.

According to a fourth aspect of the invention there is provided apparatus for recovering material from an underground location, comprising a recovery head for receiving the material to be recovered and a conveying means for conveying the material from the recovery head to the remote location, the recovery head comprising a chamber for receiving material to be recovered, a screen associated with the chamber for screening material entering the chamber, the second having a first side from material being screened passes therethrough and a second side, a plurality of elongate screen openings in the screen extending between the first and second sides thereof, a plurality of tines mounted on support means disposed on the second side of the screen each tine being movable along a path at least part of which includes one of the elongate screen openings whereby the tine is receivable in and movable along the elongate screen opening, the tine extending beyond the first side of the screen for at least part of the movement thereof along the screen opening.

According to a fifth aspect of the invention there is provided a method of recovering material from an underground location, including the steps of: forming a slurry in a zone of an underground formation containing material to be recovered, screening the slurry to exclude constituents thereof above a predetermined size, conveying the screened material to a remote location, and delivering replacement material to the zone to replace at least a portion of the material conveyed therefrom.

The slurry may be formed by fragmenting consolidated material in the zone.

BRIEF DESCRIPTION OF THE DRAWINGS

The invention will be better understood by reference to the following description of several specific embodiments thereof, as shown in the accompanying drawings in which.

DESCRIPTION OF PREFERRED EMBODIMENTS

Figure 1:
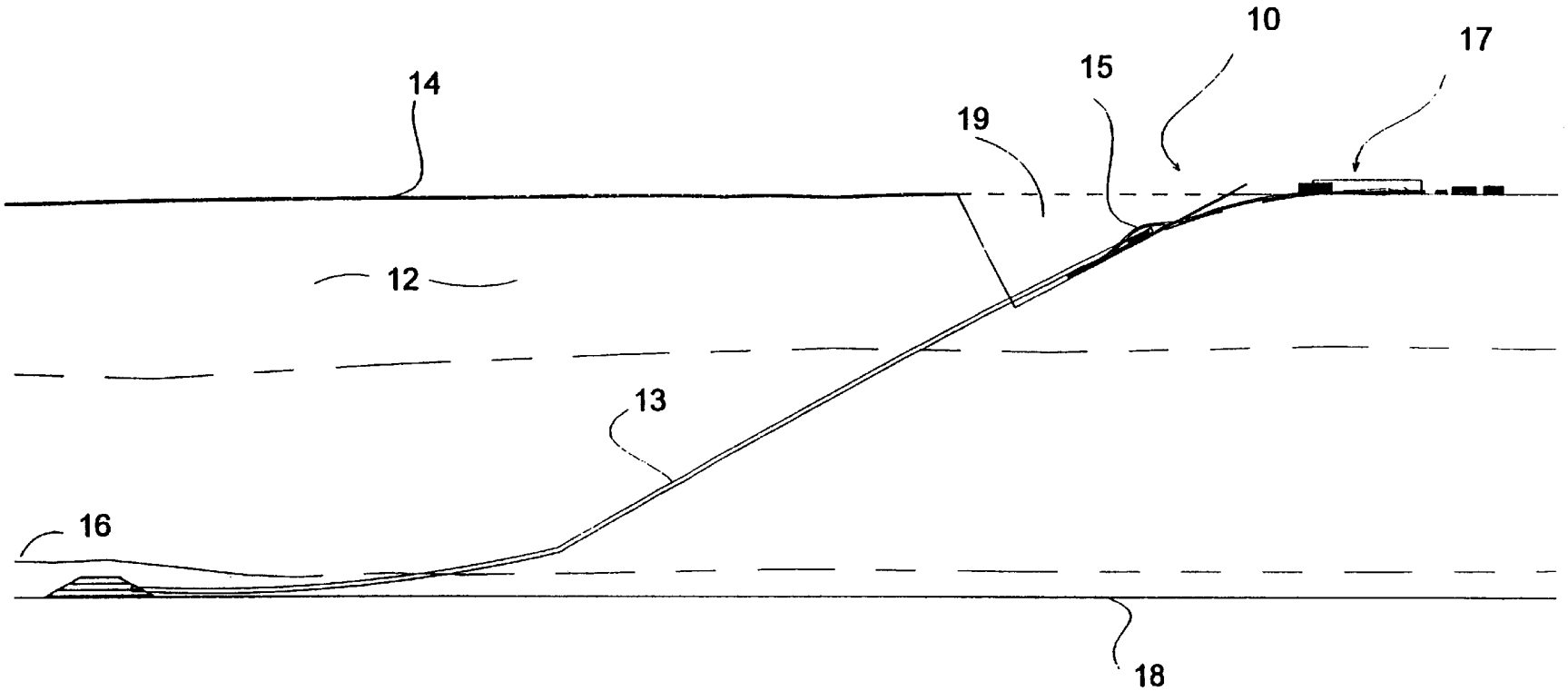
FIG. 1 is a schematic side view illustrating an underground mining apparatus according to the embodiment.

Referring to FIGS. 1 to 15 of the drawings, the first embodiment is directed to an underground mining apparatus 10 for recovering materials from normally inaccessible underground formations such as deep leads covered by an overburden of mud, sand and/or basalt. The apparatus is particularly suitable for recovery of metallic particles such as gold, diamonds, heavy metals and all alluvials present in such underground formations.

The wash of an underground stream (either active or dry) may be rich in gold bearing particles where the stream flows over bedrock in gold-bearing areas. The underground mining apparatus 10 according to the embodiment provides a way for accessing and recovering such particles.

The mining apparatus 10 comprises a recovery head 11 adapted to operate in the wash of an underground stream for recovering the metallic particles and other particles of interest. The recovery head 11 is positioned at the lower end of a pipe string 13 which in use extends through the overburden 12 from ground level 14 to wash material 16 overlying bedrock 18. A structure 15 for operating the pipe string 13 is provided at a receiving and handling station 17 situated at ground level. The handling situation includes a launching pit 19 for the pipe string.

The recovery head 11 is delivered to the wash 14 in the underground formation in any suitable fashion such as by forming a path (not shown) through the overburden along which the recovery head can travel, or by using the recovery head to progressively excavate material to create a path for itself. The path for the recovery head 11 provides an access passage along which the pipe string 13 extends during the mining operation. As the access passage is likely to be vulnerable to collapsing about the pipe string 13, it may be desirable to progressively install a supporting lining (not shown) within the access passage as it is formed. An arrangement which provides a suitable supporting lining is disclosed in the Applicant's International Application No. PCT/AU95/00667, the contents of which is incorporated herein by way of reference.

The recovery head 11 has a fore-and-aft axis (not shown) and comprises a body 21 having a suction chamber 23 within the interior thereof. The suction chamber 23 can receive slurry material, and the slurry material can be extracted therefrom and delivered to the handling station 17.

The body 21 includes an exterior casing 24 having a front wall 25 defining a frontal surface and a rear wall 27 defining a rearward surface. The front and rear walls 25, 27 are in spaced apart relation along the fore-and-aft axis of the recovery head. A top wall 29 extends between the upper ends of the front and rear walls 25, 27. The casing 24 also has side walls 30 and a bottom wall 31 which extends between the lower ends of the front and rear walls 25, 27 and which provides the base 22 of the recovery head 11. The base 22 incorporates a rigid skirt 26 which surrounds the bottom wall 31.

The front wall 25 extends rearwardly and upwardly from a leading edge section 32 defined between the front wall 25 and the bottom wall 31. The leading edge section 32 presents a blade 33 adapted to cut through the wash material on forward movement of the recovery head 11 in the direction of the fore-and-aft axis. Similarly, the rear wall 27 extends upwardly and rearwardly from a trailing edge section 34 defined between the rear wall 27 and the bottom wall 31. The trailing edge section 34 also presents a blade 35 adapted to cut through the wash material on reverse movement of the recovery head in the direction of the fore-and-aft axis. Each blade 33, 35 has a normal position in which it is inclined upwardly to react with the material through which it cuts upon relative movement of the recovery head 11 to provide lift and thereby counterbalance downward forces exerted by the recovery head.

The blades 33, 35 are, however, adjustable angularly to allow the angle of attack thereof to be selectively varied with respect to oncoming material as the recovery head 11 advances through subterranean material in its path. Such variation in the angle of attack thereof to be selectively varied with respect to oncoming material as the recovery head 11 advances through subterranean material in its path. Such variation in the angle of attack can cause the recovery head 11 to ascend or descend, dependent upon the angle selected.

The blade 33 comprises two blade sections 33*a*, 33*b* positioned in side-by-side relation. The two blade sections 33*a*, 33*b* can be selectively adjusted independently of each other. In this way, the two blade sections can each be set at an angle of attack different to each other so causing the mining head 11 to move along a somewhat spiral path. This feature can be utilised to effect, or at least assist, steering of the recovery head 11.

In a similar fashion the blade 35 also comprises two blade sections 35*a*, 35*b*.

The two blades 33, 35 (or more particularly the respective blade sections thereof) are pivotally mounted onto the portion of the mining head therebetween and are angularly adjustable under the influence of extensible power devices 39 such as hydraulic rams acting thereon.

The body 21 further includes an internal frame structure 36 within the exterior casing 24. The frame structure 36 includes a rectangular peripheral frames 37 located below the junction between the top wall 29 and each of the front and rear walls 25 and 27 respectively. The frame structure 36 further includes a truss structure 38 in the region below each of the front, rear and top walls.

The front wall 25 incorporates a screen 40 through which slurry material can pass into the suction chamber 23. Similarly, the rear wall 27 incorporates a screen 41 and the top wall 29 incorporates a screen 42 through both of which slurry material can pass into the suction chamber 23.

The screen 40 is in the form of a grizzly having a first side 43 which is exposed to oncoming slurry material and a second side 44. The grizzly comprises a plurality of longitudinal elements 45 positioned in spaced apart side-by-side relationship to define gaps therebetween. The gaps provide elongate screen openings 46 through which slurry material can pass to enter the suction chamber 23.

Figure 9:
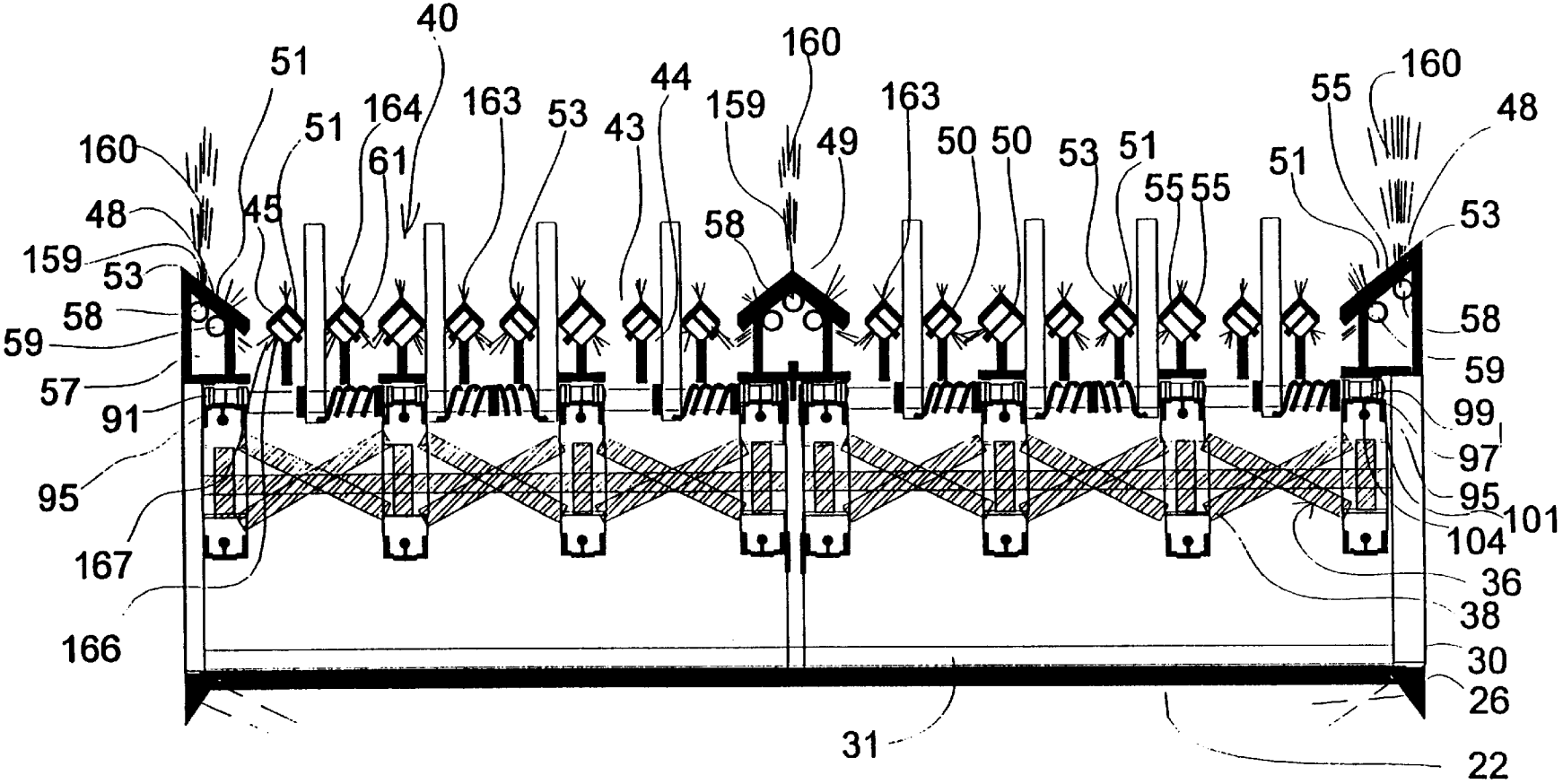
FIG. 9 is a schematic cross-sectional view through the recovery head showing the screen and tine assemblies associated with a front wall of the recovery head.
Figure 10:
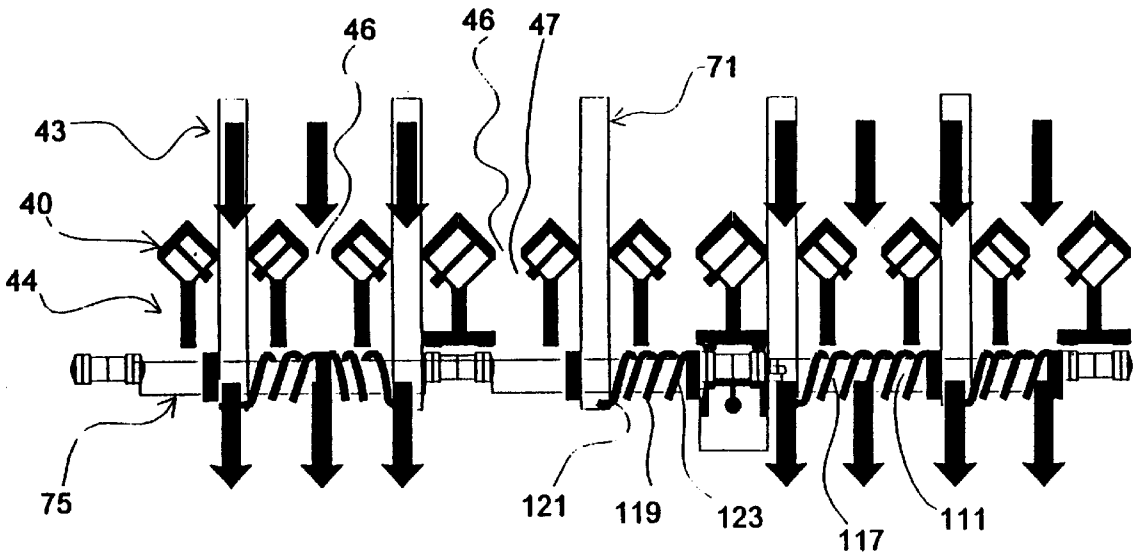
FIG. 10 is an elevational view of part of one bank of a tine assembly.
Figure 11:
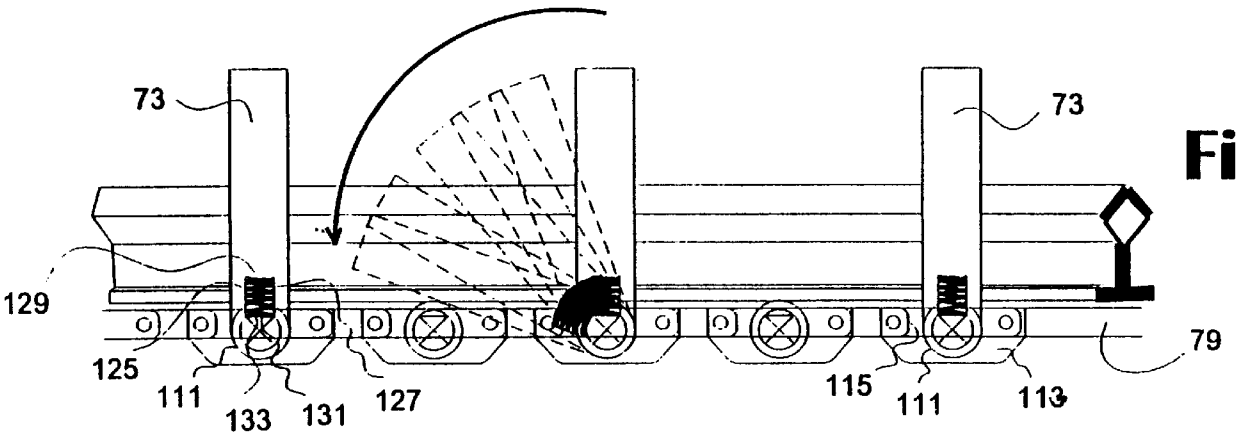
FIG. 11 is a side view showing several banks of tines in a tine assembly, with one tine being shown in outline in various deflected conditions.

The longitudinal elements 45 are of a cross-section at least a portion 47 of which tapers in a manner to progressively decrease in size with respect to the inward direction of the screen, as best seen in FIG. 9. With this arrangement, the cross-sectional shape of the elongate screen openings 46 defined between adjacent longitudinal elements 45 increases in the inward direction, with the result that particles of a size which can enter the tapering portion of the screen are unlikely to be jammed between the longitudinal elements as they pass through the screen.

The longitudinal elements 45 include two lateral elements 48 and a central element 49. The longitudinal elements 45 further include intermediate elements 50 between the central element 49 and each lateral element 48, the intermediate elements being recessed on the first side 43 of the screen 40 with respect to the lateral elements 48 and the central element 49.

Each longitudinal element 45 has an exposed face 51 on the first side 43 of the screen 40 which is configured to present a leading edge 53 to material approaching the screen. The exposed face 51 recedes from the leading edge 53 so as to direct the material towards the screen openings 46.

Replaceable wear pads 55 are provided on the exposed faces 51 to increase the service life thereof.

The central element 49 and each lateral element 48 of the screen 40 is provided with an axial passage 57 accommodating a high pressure water line 58 and a lower pressure water line 59, the purpose of which will be explained later.

Similarly the intermediate elements 50 are each provided with an axial passage 61 for conveying water under pressure, again the purpose of which will be explained later.

The screen 41 incorporated in the rear wall 27 of the casing 21 is of similar construction to the screen 40 in the front wall 25.

Figure 12:
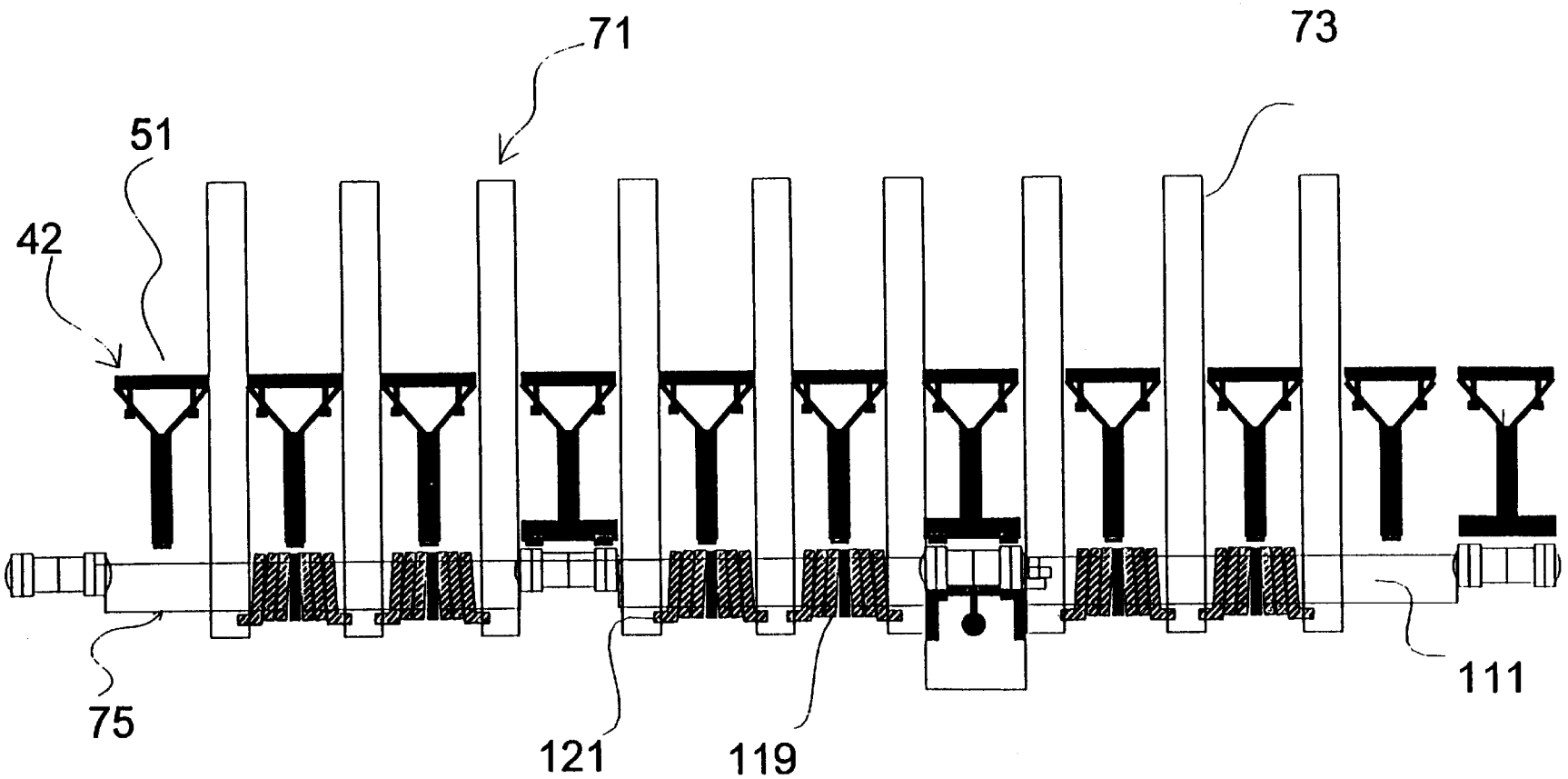
FIG. 12 is a cross-sectional view showing the screen and tine assemblies associated with a top wall of the recovery head.

The screen 42 incorporated in the top wall 29 of the casing 21 is somewhat similar to the screen 40, with the exception that the exposed face 51 of each longitudinal element is flat, as best seen in FIG. 12 of the drawings. This is to provide a relatively flat surface along which can move relatively large material of a size which cannot pass through the screens. The exposed face 51 could, however, be of a similar configuration to the exposed face of each longitudinal element in the screens in the front and rear walls 25 and 27 respectively.

Each of the screens 40, 41 and 42 has a respective tine assembly 71 associated with it. The tine assemblies 71 serves various functions, including removal of any material accumulating in the elongate screen openings 46 within the screen. The tine assemblies 71 also act to prevent the accumulation of over-size materials such as rocks and boulders on the outer face of the screens 40, 41 and 42. Additionally, the tine assemblies 71, and more particularly the tine assembly associated with the front screen 40, serve to fragment oncoming materials in the path of the recovery head 11, as will be explained later.

Each tine assembly 71 comprises a plurality of tines 73 each of which is movable along a respective cyclical path part of which includes one of the elongate screen openings 46 in the respective screen. With this arrangement, the tines 73 are receivable in and movable along their respective screen openings 46.

Another part of the cyclical paths has the lines 73 passing through the suction chamber 23. As the tines move through the suction chamber 23, they have a paddle effect on slurry within the chamber so as to cause agitation of the slurry and thereby assist in maintaining solids in suspension.

The tines 73 are each of a length to extend beyond the first side 43 of the respective screen for most part of movement thereof along the screen opening. The tines 73 are supported on a support means 75 comprising a closed loop structure 77 adapted for cyclical movement. The closed loop structure 77 comprises a plurality of laterally spaced apart endless chains 79 each of which passes around a first end sprockets 81 and a second end roller 82. The first end sprocket 81 in each tine assembly 81 are mounted a common drive shaft (not shown) for rotation therewith. The drive shaft is rotatably supported on the internal frame structure 36 within the body 21 and is drivingly coupled at its ends to a drive system 85. The drive system 85 comprises two hydraulic motors 87 mounted within the body 21 of the recovery head 11. Each hydraulic motor 87 is drivingly coupled to a respective end of the drive shaft 83 by way of a chain device 89 operating in an oil bath (not shown).

The hydraulic motors 87 for driving the various tine assemblies 71 operate in a hydraulic circuit which includes a hydraulic pump (not shown) driven by electric motors (not shown) accommodated in the body 21 of the recovery head 11.

Each endless chain 79 has an upper run 93 and a lower run 94 extending between the end sprockets 81, 82. The upper run 93 of each endless chain 79 extends along, and is supported by, a runner 93 which is carried on the internal frame structure 36. The runner 95 supports the upper run 93 of the endless chain 79 to resist inward deflection thereof when the tines 73 are under load. The runner 95 presents a contact face 97 formed of low-friction material such as Delrin. The low-friction contact face 97 is provided by a replaceable wear plate 99 which is detachably mounted onto a longitudinal member 101. The longitudinal member 101 has an axial passage 103 accommodating a flow line 104 which receives cleansing fluid (such as water) under pressure. Fluid outlet nozzles 105 are provided at intervals along the length of the contact fact 97 of the runner 93 through which the cleansing fluid can spray onto the endless chain 79 as it travels along the runner 95. This is for the purpose of cleaning the endless chain 79 with a view of reducing the aggressive affects of contamination of chain by slurry entering the suction chamber 23 through the screens.

The lower run 94 of each endless chain 79 passes around a tensioning sprocket 107 which is adjustable for controlling tension in the chain.

The chains 79 are each so positioned in relation to a respective one of the intermediate longitudinal elements 50 as to be shielded thereby from slurry entering through the screen.

The cyclically movable closed loop structure 77 includes elongate support elements 111 which extend transversely between adjacent endless chains 79 and which support the tines 73. The support elements 111 have mounting plates 113 at the end thereof each of which is attached to a respective one of the links 115 of the endless chain 79.

The tines 73 are rotatably mounted on the support elements 111 for angular movement in a manner which allows the tines to deflect rearwardly (as illustrated schematically in FIG. 11) upon encountering an unmanagable obstruction (such as a large boulder) which can neither be moved nor fragmented. The rearward angular deflection of the tines allows them to sweep passed the obstruction without damage to the tine. A spring means 117 is provided for yieldingly resisting such deflection of each tine 73 and to return the tine to the normal condition after it has moved clear of the obstruction. Each spring means 117 comprises a cylindrical helical spring 119 fitted onto the respective support element 111, with one end 121 of the spring acting on the tine 73 and the other end 123 fixed with respect to the support element 111.

Each tine 73 incorporates a detent 125 which co-operates with the elongate support element 111 to yieldingly resist the initial stage of angular movement of the tine. The detent 125 comprises a compression spring 127 accommodated in a recess 129 within the tine 73 and having an end 131 thereof exposed for contact with the elongate support element 111. The elongate support element 111 has an abutting section 133 against which the compression spring 127 bears when the tine 73 is in the normal (undeflected) condition. The abutting section 133 is flat or otherwise shaped to induce further compression in the spring 127 during the initial stage angular movement of the tine as it moves out of the normal (undeflected) condition. It is the further compression induced in the compression spring 127 which yieldingly resists the initial deflection of the tine. Cooperation between the compression spring 127 and the abutting section 133 together with the wall of the recess 129 also serves to positively locate the tine 73 with respect to the elongate support element 111 when the tine returns to the normal condition under the influence of the cylindrical helical spring 119.

Figure 3:
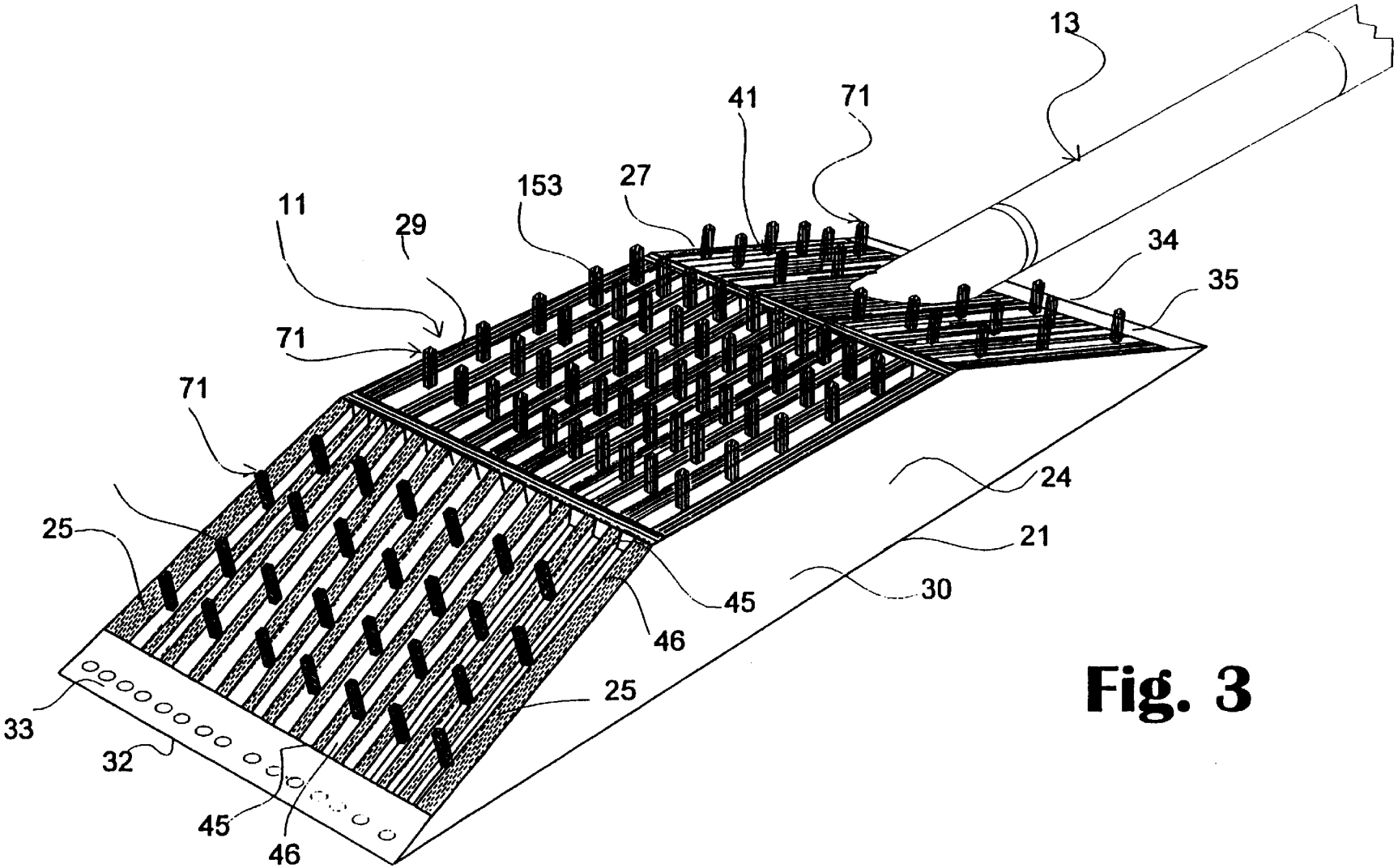
FIG. 3 is a schematic perspective view of the recovery head.
Figure 4:
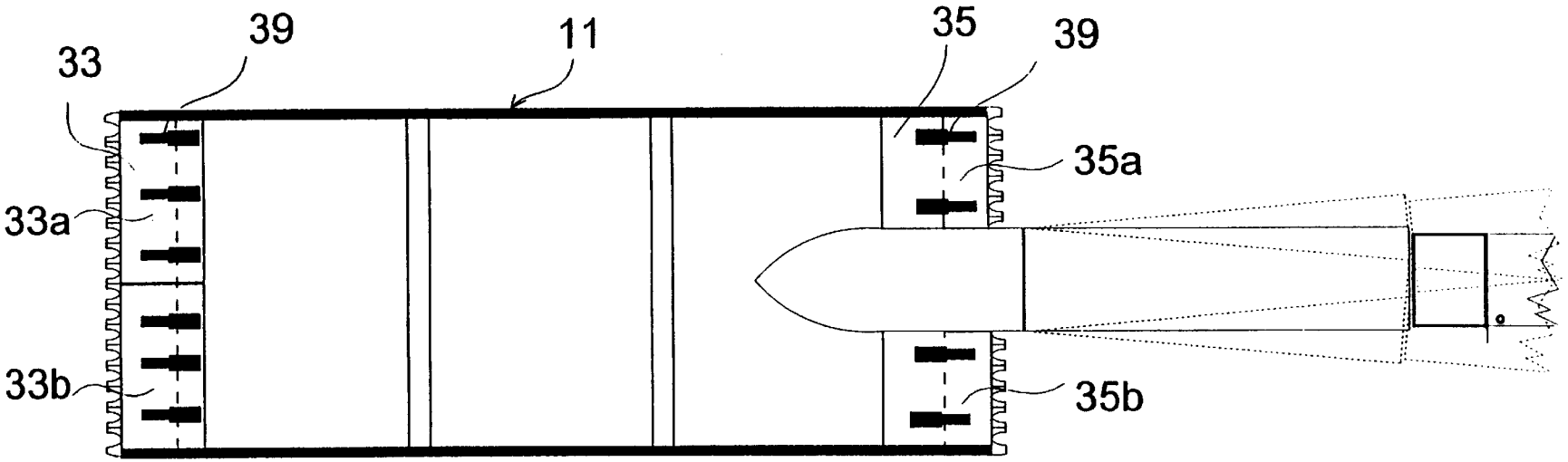
FIG. 4 is a plan view of part of the structure of the recovery head, showing control blades at each end thereof.
Figure 5:
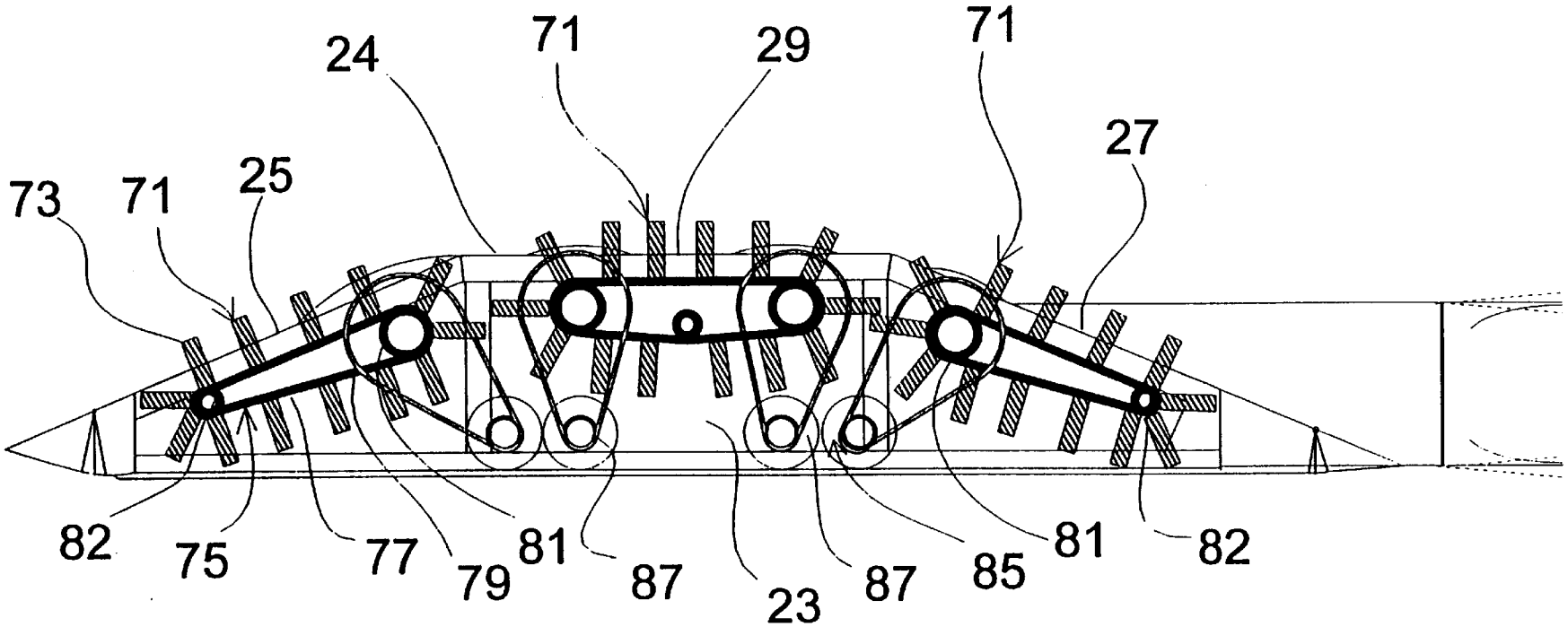
FIG. 5 is a schematic sectional side view of the recovery head showing tine assemblies therefor.
Figure 6:
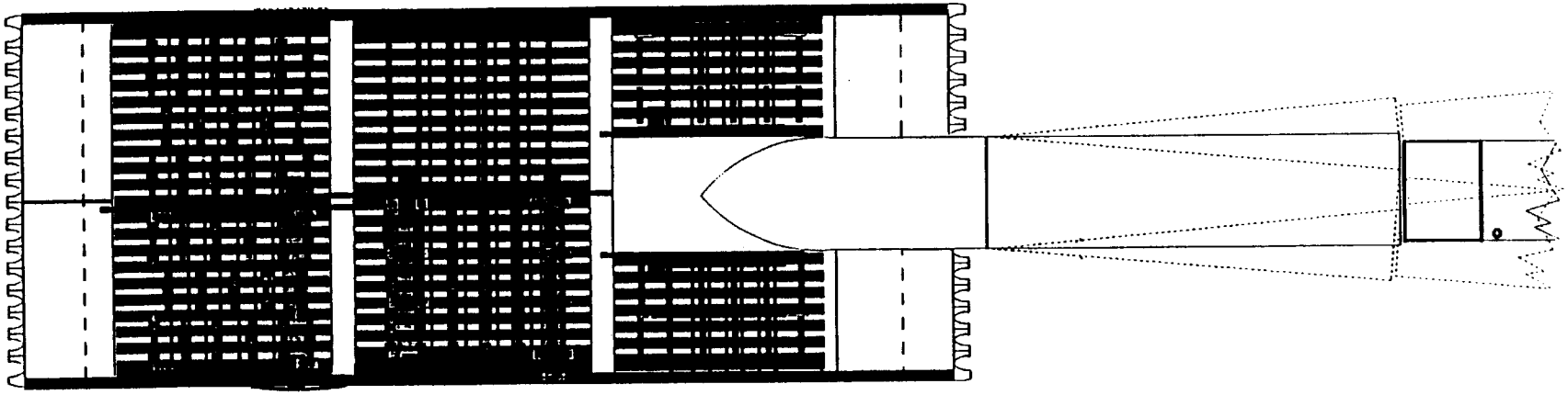
FIG. 6 is a plan view of the recovery head.
Figure 7:
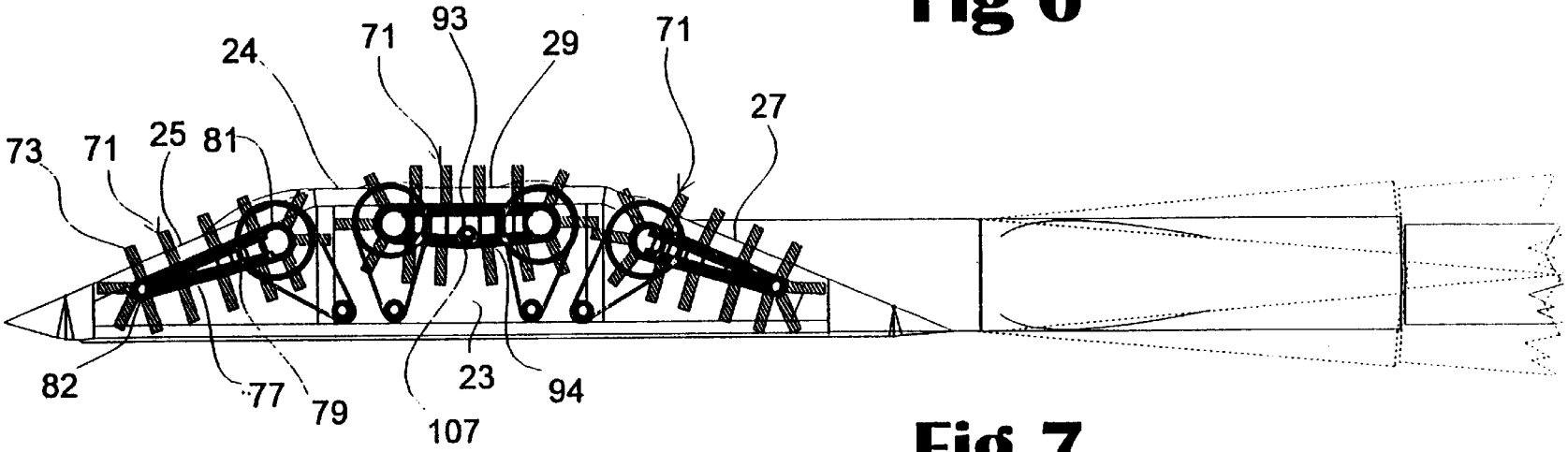
FIG. 7 is a side view of the recovery head showing details of the support means for the tines.
Figure 8:
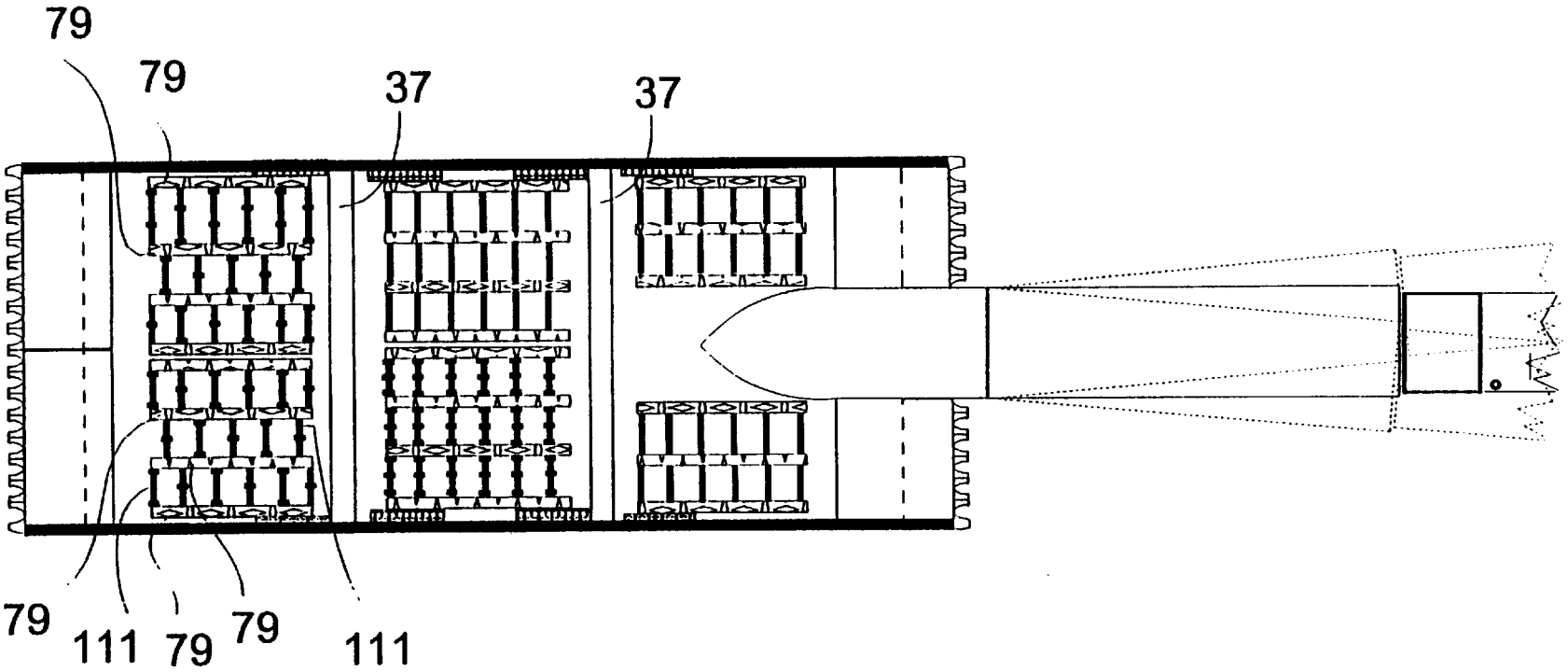
FIG. 8 is a plan view of the recovery head (with the screens removed) showing the tine assemblies.

The tines assembly 71 associated with the front screen 40 and rear screen 41 are so arranged that the tines 73 thereof in adjacent elongate screen opening 46 are offset with respect to each other, as best seen in FIG. 3. With this arrangement, the tines 73 are arranged in banks 151 with the tines 73 in each bank positioned to occupy alternate elongate screen openings 46. This arrangement of the tines 73 is conducive to establishing and maintaining turbulent conditions in slurry material in the vicinity of the screens 40, 41.

While the tine assembly 72 associated with the top screen 42 also serves to maintain turbulent conditions, it more importantly has a role in propelling the recovery head 11 along underground through traction by gripping engagement with the material surrounding the recovery head. Because of this requirement, the tines 73 in the tine assembly 71 associated with the top screen 42 are arranged in banks 153 with the tines in each bank being so arranged that each elongate screen opening 46 is occupied by one of the tines.

As mentioned above, the tines 73 are arranged to fragment consolidated materials such as clay in the path of the recovery head as it advances through the wash. The fragmentation process is assisted by high-pressure jets of water issuing from the various nozzles provided in recovery head 11.

Figure 13:
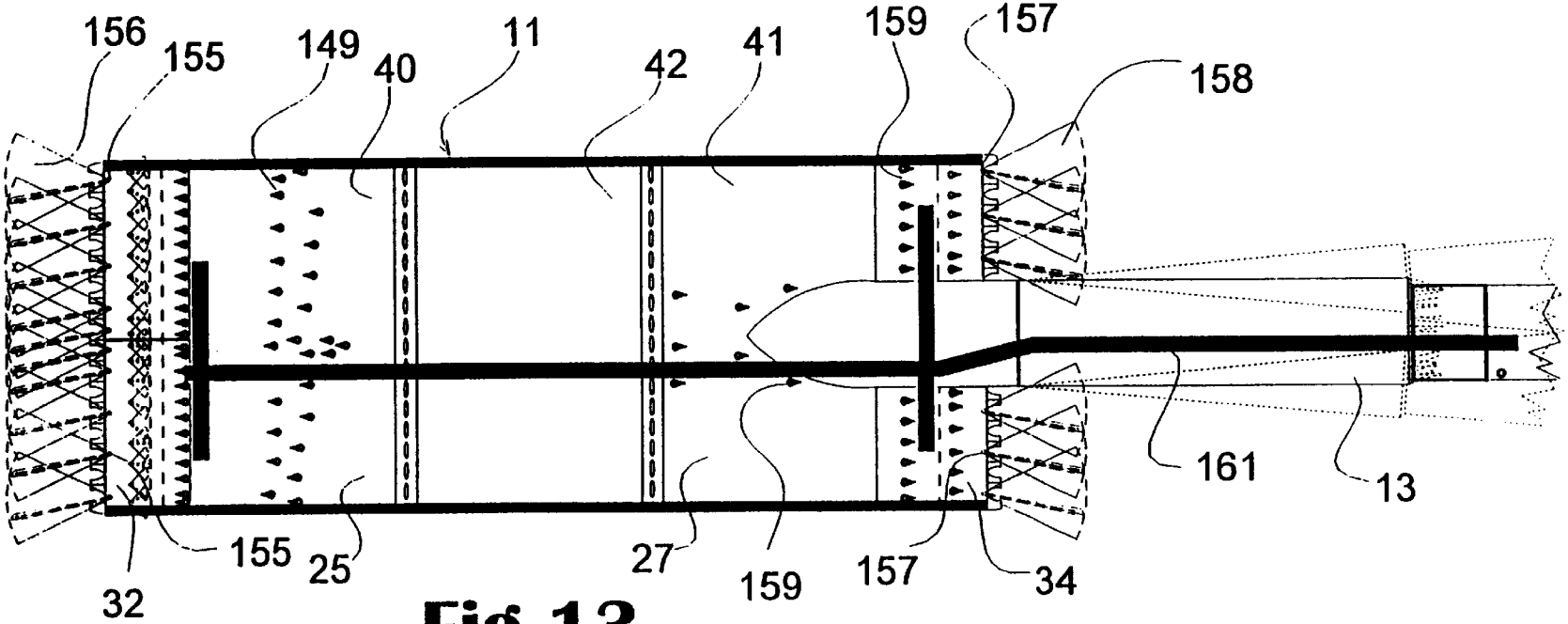
FIG. 13 is a plan view of the recovery head showing various high pressured nozzles incorporated therein and some spray patterns for such nozzles.
Figure 14:
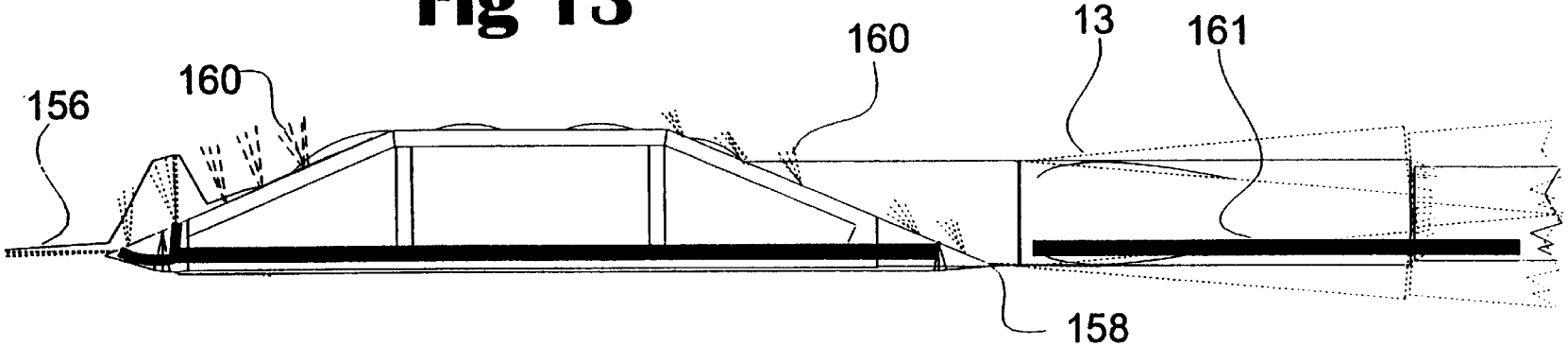
FIG. 14 is a side view of the arrangement shown in FIG. 13.
Figure 15:
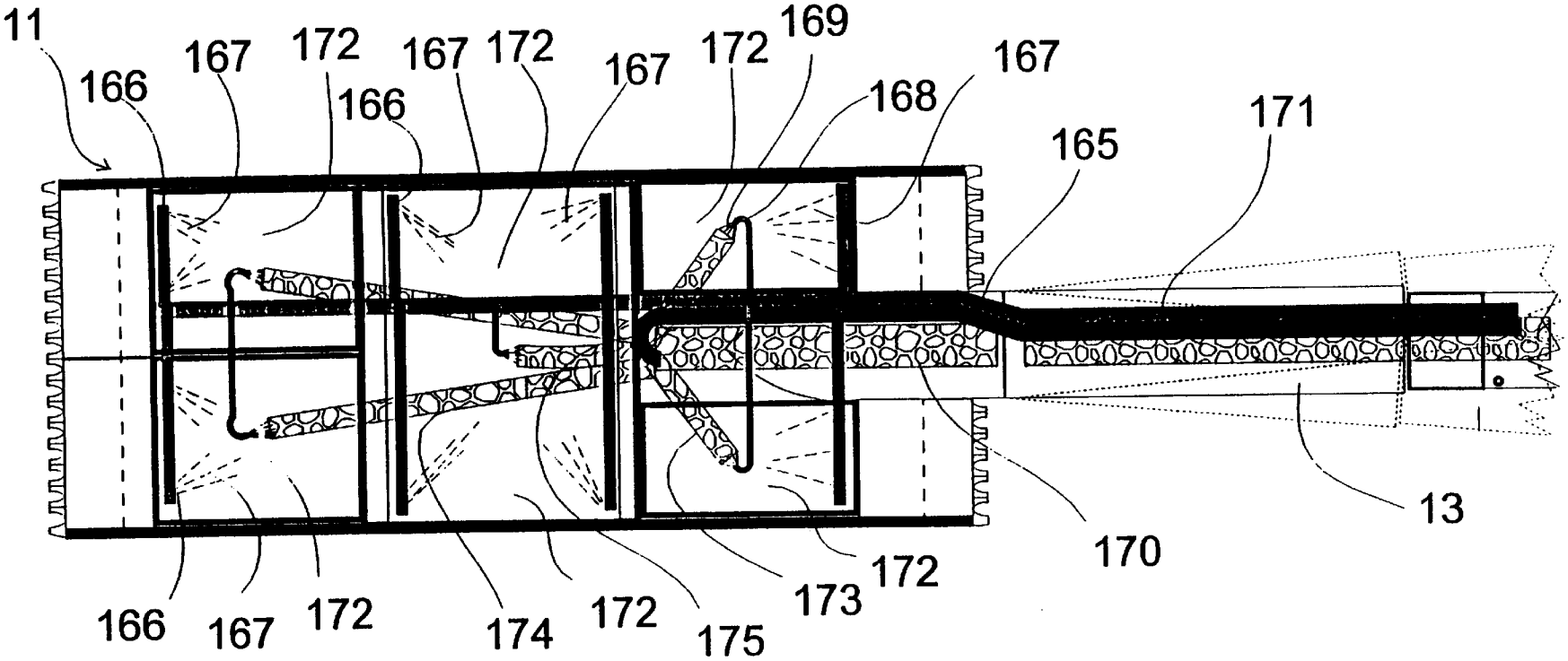
FIG. 15 is a schematic plan view showing an arrangement of various nozzles within the interior of the recovery head.

As shown in FIGS. 13 and 14, the nozzles include nozzles 155 on the leading edge section 32 for issuing forwardly directed jets of water (as depicted in outline and identified by reference numeral 156). Similarly, the nozzles include nozzles 157 on the trailing edge section 34 for issuing rearwardly directed jets of water 158. Further, the nozzles include nozzles 159 in the front wall 25 and rear wall 27 for issuing upwardly directed jets of water 160.

The various nozzles 155, 157 and 159 receive high pressure water from a first water delivery line 161 and an associated distribution system which includes high pressure water lines 58 accommodated on the central longitudinal element 49 and each lateral longitudinal element 48 of the screen 40. The high pressure water lines convey the high pressure water to nozzles 159 in the central longitudinal element 49 and each lateral longitudinal element.

The jets of high pressure water assist in fragmenting consolidated material impacted by the jet streams and may also assist in formation of the slurry.

Various other nozzles 163 are also provided on the recovery apparatus for issuing lower pressure jets of water 164.

The jets 164 are provided for the purpose of establishing a fluid bed on the outer face of each screen for suspending rocks, boulders and other materials which are over-size as well as any light materials, so that the heavy particles can be drawn through the fluid intake openings 46 in the screen and into the suction chamber 23. The particular nozzles 163 which are provided on the screens 40, 41 and 42 may be operable under the influence of sensors which are adapted to sense the presence of large rocks or boulders in contact with the respective screen surface. In this way, the nozzles 163 operate to provide the jets 164 only when required.

The nozzles 163 receive lower pressure water from a second water delivery line 165 and associated distribution system which includes the lower pressure lines 59 in the central longitudinal element 49 and each lateral longitudinal element 48 in the screen 40, and which further includes the axial passages 61 in the intermediate longitudinal elements 50.

The distribution system associated with the second water delivery line 165 also delivers lower-pressure water to various nozzles 166 which discharge jets of water 167 into the suction chamber.

Further the distribution system associated with the second water delivery lind 165 delivers water to nozzles 168 which are located in the suction chamber 23 and which discharge jets 169, the purpose of which will be explained later.

Further jet outlets 169 are provided for injecting water under pressure into the region below the bottom wall 31 of the casing 24 surrounded by the skirt 26 hereby to provide a fluid cushion fur providing support to the recovery head 11 and thereby assisting in its movement through the wash.

Steering nozzles (not shown) are located at the coners of the base 22 of the recovery head. The steering nozzles can provide outwardly directed jets of water in a controlled fashion to react with the material surrounding the recovery head 11 and thereby assist steering thereof.

Means (not shown) may be provided to provide water films or other fluid zones immediately adjacent or other fluid zones immediately adjacent the side walls 30 of the casing 24 to further reduce friction on the casing and thereby assist its movement.

The pipe string 13 accommodates a pipe 170 for upward conveyance of the slurry material. The lower end of the pipe 170 communicates various sections 172 within with the suction chamber 23 by way of branch lines 173. In this way, screened slurry contained within the suction chamber can be evacuated therefrom and conveyed to the receiving and handling station 17 at ground level. The intake end of each branch line 173 is positioned at the bottom of each suction chamber section 172. The jets 167 issuing from nozzles 167 urge slurry material towards the intake ends of the branch lines 173. Further, the jets 169 issuing from nozzles 168 positioned in close proximity to the intake ends of the branch lines 173 serve to force slurry material into the intake ends.

An eductor pump 175 is associated with the pipe string 13 for conveying the slurry upwardly along the pipe string 13 from the suction chamber 23.

Water under pressure is delivered to the recovery head 11 for various uses such as various jet outlets and operation of the eductor pump 175 by way of a third water delivery line 171 incorporated in the pipe string 13.

The pipe string 23 is also arranged to deliver replacement material to the mining head to replace at least a portion of the slurry material conveyed to the wash. The replacement material may comprise water, or any other suitable fluid or a slurry. The replacement material is basically a substitute for the volume of material removed from the underground formation during the mining process. This ensures that the overburden above the wash remains supported to a certain extent. The replacement material may comprise tailings from a processing operation performed on previously recovered material.

The pipe string 23 incorporates separate passages for the various functions it provides; that is, there are separate passages for upward conveyance of the slurry material, downward conveyance of the replacement material, and accommodation of cabling and other service lines. The pipe string also accommodates the three water delivery lines 161, 165 and 171.

While it is preferred that the various passages are included in a single pipe string, it is of course possible to provide separate drill strings for the passages.

The pipe string 13 is of a flexible construction in order to accommodate directional changes of the recovery head 11.

The recovery head 11 is navigated through the wash by operation of control systems from ground level. Directional control of the mining head is accomplished by selective operation of the tine assemblies 71, angular adjustment of the sections of the blades 33, 35, and selective operation of the steering jets.

The extension and retraction of the pipe string 13 is carried out at ground level by insertion and removal of lengths to the pipe string at an operating structure at ground level.

The recovery head 11 carries various sensors (not shown) as part of the control system which continuously observes and actively controls all aspects of the underground mining operation. The controls may include navigational controls, radiation sensors, and detection devices such as metal detectors for detecting the structure of the deposit and identifying the location of precious materials. The sensors may also include acoustic sensors to determine the distance between the working face of the mining head and consolidated material in its path, and to also determine if consolidated material has been effectively slurried.

While not shown in the drawings, a rock cutting blade may be provided at the particular end of each screen opening 46 towards which the respective tines 73 moving therealong travel. The blade is of V-shape and is designed to fracture rocks trapped in the opening and push therealong by one of the tines into engagement with the blade. It is particularly suitable for fracturing rocks which are tapered (somewhat in the shape of a carrot) and which are otherwise difficult for the tines to remove.

Figure 2:
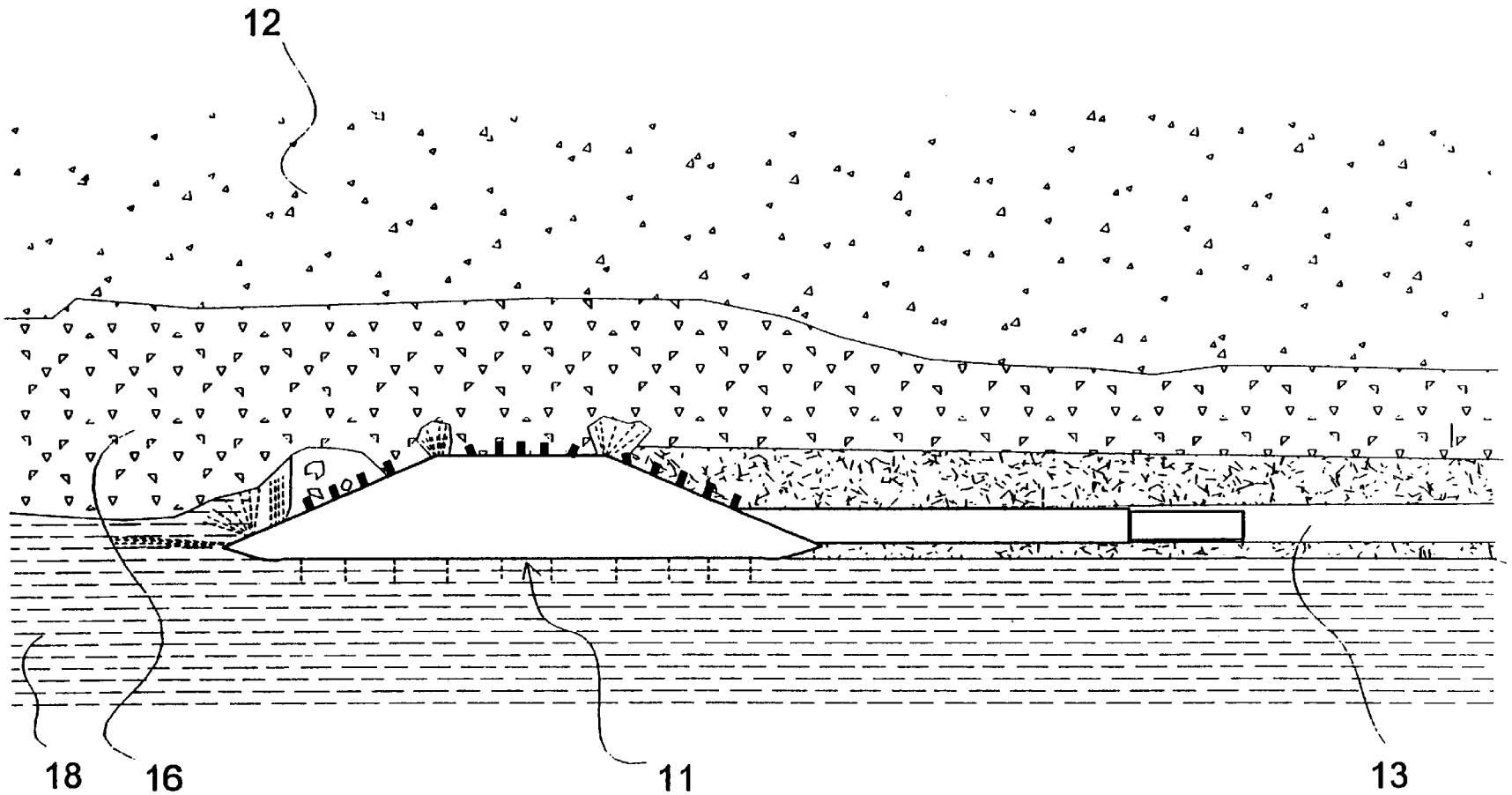
FIG. 2 is a schematic side view showing a recovery head forming part of the underground mining apparatus of FIG. 1.

When an underground deposit is to be mined, the receiving and handling station 17 is established at ground level in the vicinity of the deposit. The overburden is then penetrated downwardly from ground level in any suitable way to establish a passage through which the recovery head 11 can be delivered to the deposit on the end of the drill string 13. When the recovery head 11 is at the appropriate deposit, the mining operation can commence. The recovery head 11 is advanced along wash material and the pipe string 13 extended accordingly. As the recovery head 11 advances, the tines 73 are rotated to fragment solid materials such as clay in the wash material and generate a slurry containing the material to be recovered. The fragmentation process and generation of the slurry may be assisted by jets of water issuing under pressure from the recovery head. Boulders and rocks which are over-sized are swept along and then clear of the screens 41 by the tine assemblies 71. The tine assemblies 71 typically carry the over-size material up the front face of the recovery head to be deposited behind the advancing recovery head, across the upper face, and down the rear face to the region behind the recovery head, as shown in FIG. 2. The tines also remove any particles trapped in the screen openings 46.

The slurry material within the suction chamber 23 is conveyed to the handling and receiving station 17 at ground level along the pipe string 13. At ground level, the slurry can be further processed to recover constituents of interest, such as precious metal particles and quarts. If the mining head encounters a boulder which is too large to be moved by the tines, the mining head can reverse and chose an alternative path.

Slurry material conveyed from the deposit to ground level is replaced with replacement material delivered to the mining head along the pipe string. The replacement material serves to occupy the volume left by the removed material and so maintains the stability of the region undergoing the mining operation.

The recovery head 11 can advance in a forward direction in the manner described, depositing over-sized material behind it as it advances.

Replacement material for replacing slurry material conveyed to the remote location is also deposited behind the advancing recovery head.

In circumstances where the recovery head 11 is required to move in the reverse direction, the direction of rotation of the various tine assemblies 71 is reversed so as to propel the recovery head in the required direction through the material which was previously deposited behind the recovery head when it was advancing forwardly. Because such material is in a disturbed condition, progress therethrough is unlikely to be difficult. The rotating tines can carry the material over the recovery head in the manner previously described in relation to forward movement as the recovery head moves through the deposited material.

To assist in such reverse movement of the recovery head 11 through the deposited material, the recovery head may be provided with a transfer means for transferring the deposited material from the rear end thereof to the front end thereof as it moves in the rearward direction. The transfer means may comprise a transfer duct through which the material can pass, the transfer duct extending between the front and rear walls 25, 27 of the recovery head. A conveying means such as an Archimedian screw may be provided in the transfer duct to convey the deposited material therethrough.

In the first embodiment, which is shown in FIGS. 1 to 15, the recovery head has screens in the front, rear and top walls of the casing 23.

Figure 16:
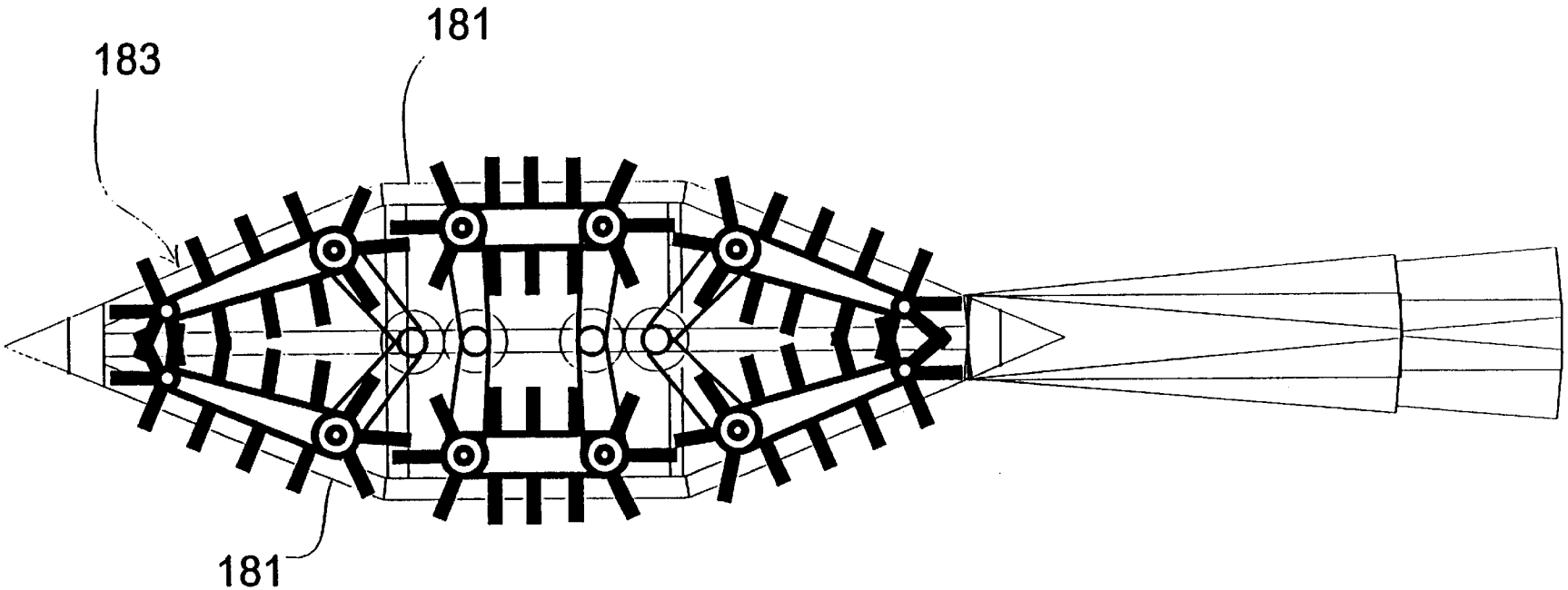
FIG. 16 is a schematic plan view of a recovery head according to a second embodiment.
Figure 17:
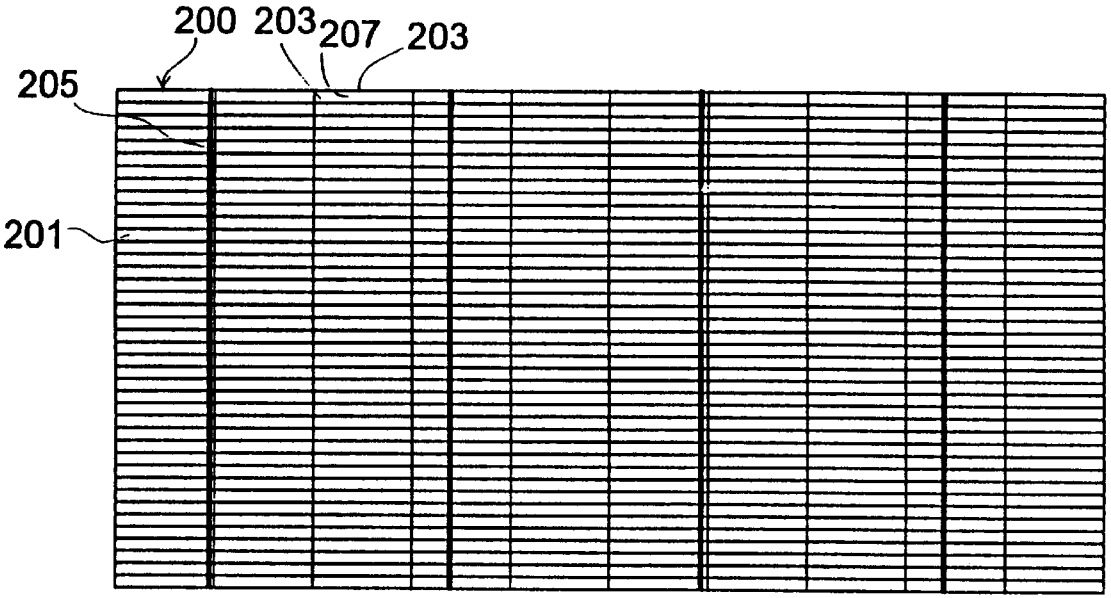
FIG. 17 is a plan view of the screen of a screening device according to a third embodiment.
Figure 18:
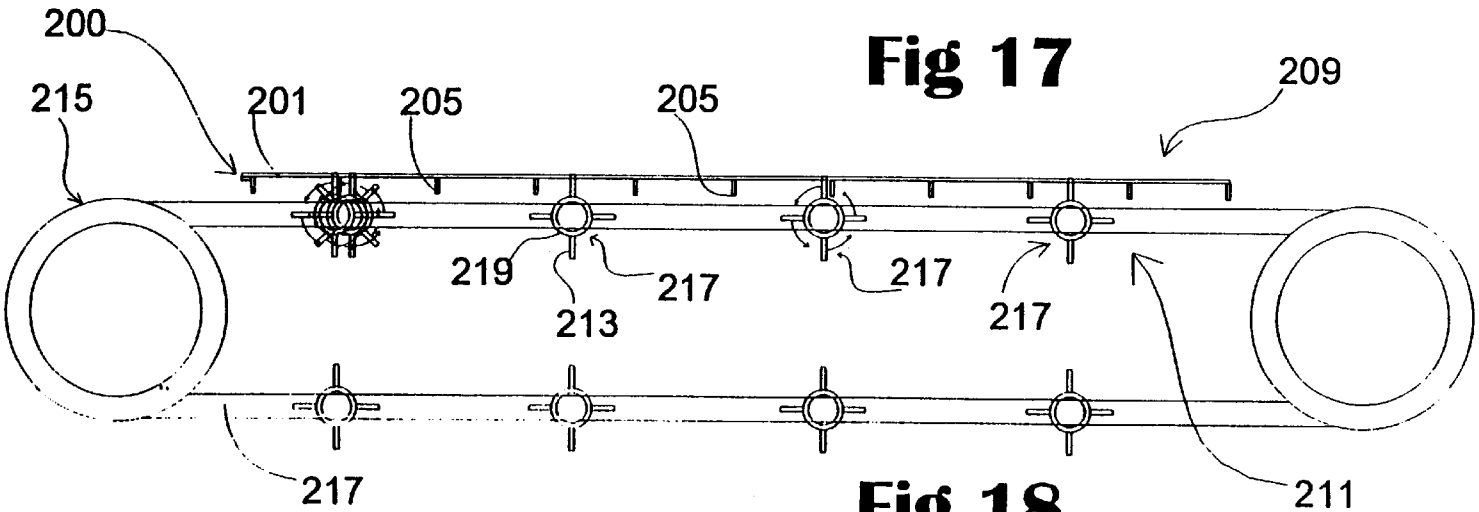
FIG. 18 is a schematic side view of the screen device according to the third embodiment.

The second embodiment which is shown in FIG. 16 is somewhat different to the first embodiment in that screens are provided in side walls 181 of the casing 183.

In the first embodiment, the screens 40, 41 and 42 are each in the form of a grizzly. This is required because of the need for the screens to be of robust construction owing to the harsh environment in which the recovery head is required to operate. There may be situations where a screening device is required to perform finer screening operations in an environment which is not so harsh. The embodiment shown in FIGS. 17 to 20 is directed to such a screening device.

The screening device 200 according to this embodiment comprises a screen 201 of conventional wedge-wire construction. The screen 201 comprises a plurality of slats 203 of wedge-shape cross-section, such slats being known as wedge-wires. The slats 203 are supported on, and fixed to, cross-members 205 extending transversely of the slats at intervals along the length of the screen 201.

The slats 203 are in parallel, spaced-apart relationship to define elongate screen openings 207 therebetween.

The screen 201 has a first side 209 which is presented to material to be screened, and a second side 211.

A plurality of tines 213 are mounted on a support means 215 disposed on the second side 211 of the screen. The support means 215 comprises a cyclically movable closed loop 217 such as an endless chain. Each tine 213 is movable along a path which includes one of the screen openings 207 and during which the tine extends beyond the first side 209 of the screen.

Figure 20:
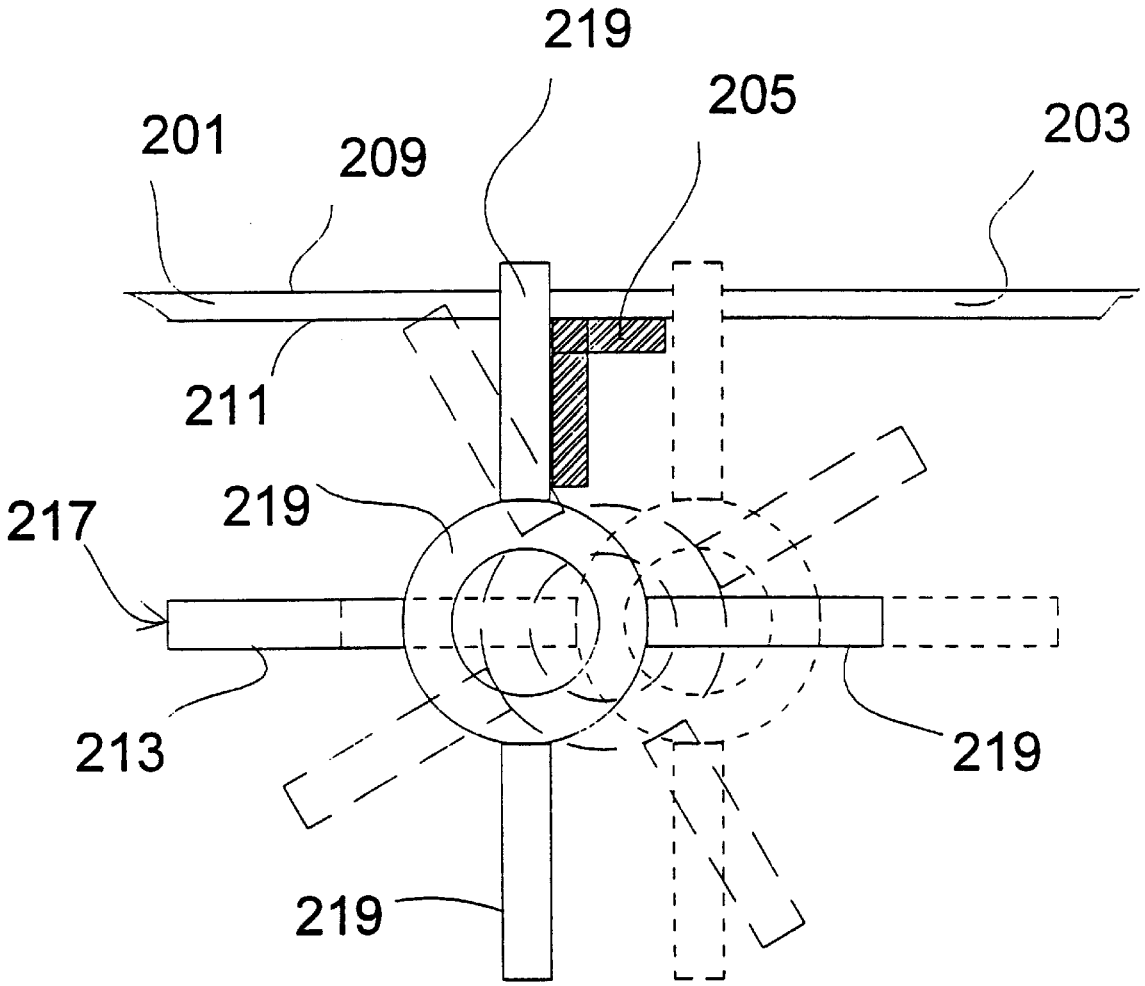
FIG. 20 is a fragmentary sectional view of the screening device of the third embodiment showing detail of a set of tines in which one of the tines is caused to deflect rearwardly owing to contact with a cross member forming part of the screen.

Because of the construction of the screen 201, the cross-members 205 provide obstructions to movement of the tines 213 along the screen openings. The tines 213 must therefore be movably supported on the support means 215 so as to be capable of deflection to pass the cross-members 205. For this purpose, each tine 213 may comprise one of a set of tines 217 mounted in a radial arrangement on a hub 219 rotatable about an axis of rotation transverse to the cyclical path of movement of the set of tines. Each set of tines 217 is arranged for step-by-step rotation so that upon one tine 213 in the set encountering one of the cross-members 205, or indeed some other immovable obstruction, the set of tines 217 is caused to rotate thereby deflecting the tine rearwardly to pass the obstructing cross-member, as shown in FIG. 20. As the tine deflects, the set of tines indexes to position another one of the tines in the screen opening.

The sets of tines 217 are positioned in banks 220 which extend across the screen 201. The hub 219 on which the various sets of tines in each bank 220 are supported is common to all of the sets in each bank and therefore indexes the sets of tines in each bank in unison.

Figure 19:
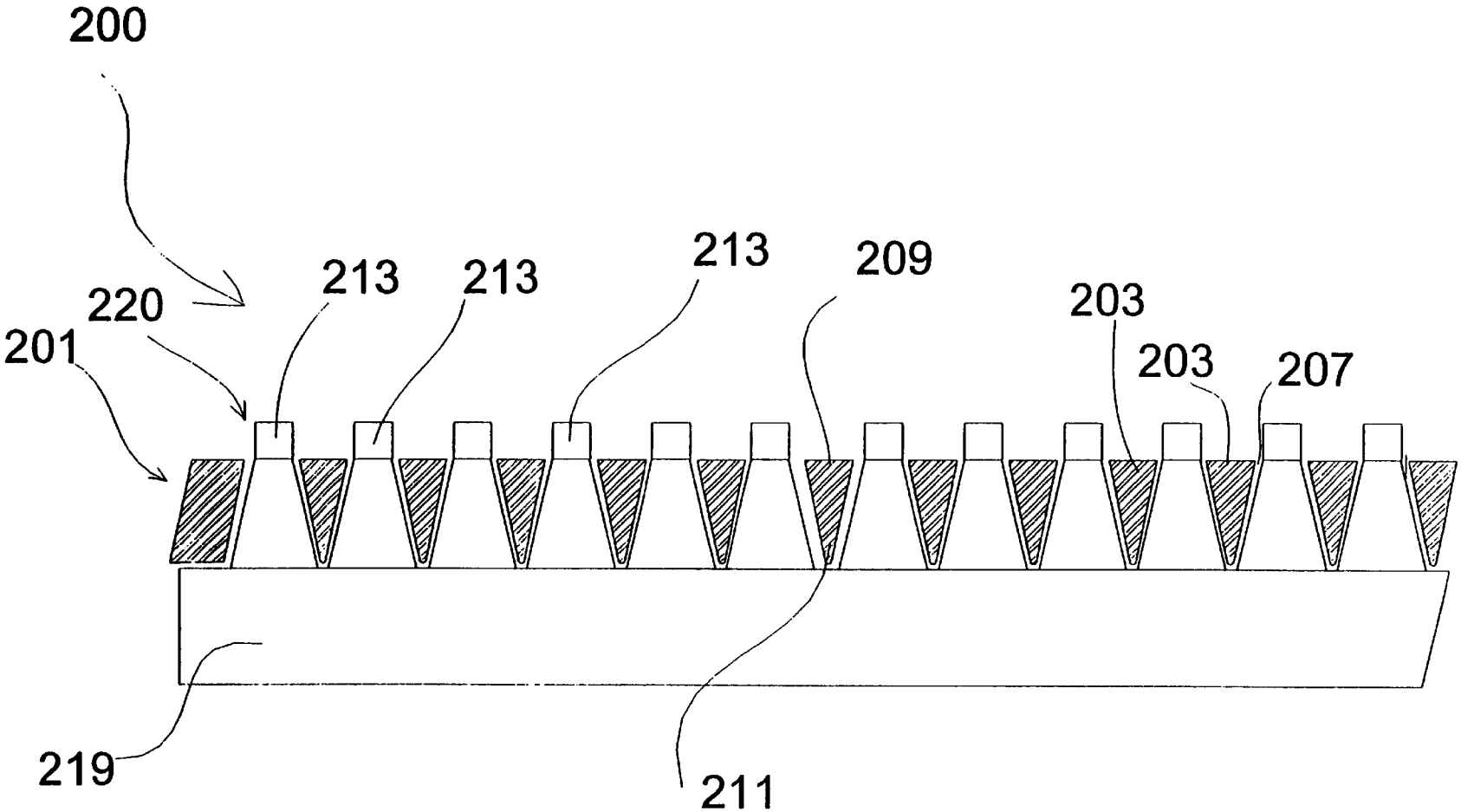
FIG. 19 is a fragmentary cross-sectional view of the screen of the screening device of the third embodiment with various tines positioned within screen openings therein.

The tines 213 are each of a complementary shape to the cross-sectional shape of the screening openings 207 so as to be a snug clearance fit therein, as shown in FIG. 19.

As with earlier embodiments, the tines 213 can clear obstructing material away from the first side 20 of the screen 201.

The screening device 200 according to this embodiment may be useful in various applications when a screening operation is required. The screening device 200 may be movable and advanced through material to be screened. Alternatively, the screening device 200 may be installed at a stationary location and material to be screened delivered to it.

What is claimed is:

1. A screening device comprising a screen having a first side for presentation to material to be screened and a second side, a plurality of screen openings in the screen extending between the first and second side thereof, a plurality of tines mounted on support means disposed on the second side of the screen, each tine being moveable in a first direction along a path at least part of which includes one of the screen openings whereby the tine is receivable in and moveable along the screen opening, the tine extending beyond the first side of the screen for at least part of the movement thereof along the screen opening, the tines being moveably mounted on the support means for deflection away from said first direction while continuing to move in said first direction upon encountering an obstruction.

2. A screening device according to claim 1 wherein the support means is adapted to move each tine along a cyclical path.

3. A screening device according to claim 2 wherein the support means comprises a closed loop structure adapted for cyclical movement.

4. A screening device according to claim 2 wherein the closed loop structure includes an endless chain.

5. A screening device according to claim 3 wherein the closed loop structure comprises elements transverse to the direction of travel of the closed loop structure, the tines being mounted on the elements.

6. A screening device according to claim 1 wherein there is provided a drive means for driving the closed loop structure for cyclical movement thereof.

7. A screening device according to claim 1 wherein the tines are resilieantly movable with respect to the support means for yieldingly resisting said deflection and returning to an undeflected condition after moving clear of the obstruction.

8. A screening device according to claim 1 wherein the screen comprises a grizzly.

9. A screening device according to claim 1 wherein the screen comprises slats disposed in spaced apart relation to define the screen openings therebetween and supporting cross-members extending transversely of the slats.

10. A screening device according to claim 9 wherein the tines are movably supported on the support means for deflection to pass the cross-members.

11. A screening device according to claim 10 wherein each tine comprises one of a set of tines mounted in a radial arrangement about an axis of rotation transverse to the cyclical path of movement of the set of tines, each set of tines being arranged for step-by-step rotation so that upon one tine in the set encountering one of the cross-members the set of tines is caused to rotate thereby deflecting the tine rearwardly to pass the obstructing cross-member.

12. A screening device according to claim 11 wherein a plurality of sets of tines are positioned in a bank extending across the screen.

13. A screening device according to claim 12 wherein the sets of tines are in the bank are mounted on a common hub which rotates with the sets of tines in unison.

14. A screening device according to claim 1, wherein the screening device is a component of a recovery head for recovering material from an underground location.

15. A screening device according to claim 14, wherein the recovery head further comprises a body adapted for movement through an underground zone, a chamber provided within the body into which material to be recovered can enter after passing through the screening device and from where such material can be conveyed to a remote location.

16. A screening device according to claim 15 wherein the body has a frontal surface extending upwardly and rearwardly with respect to the normal direction of forward travel of the recovery head and which is presented to oncoming material as the recovery head advances through the underground zone, the screening device being located in or otherwise associated with the frontal surface.

17. A screening device according to claim 16 wherein the frontal surface has a leading edge at the lower end thereof which provides a blade to facilitate passage of the recovery head through the underground zone.

18. A screening device according to claim 16 wherein the body has a rearward surface extending downwardly and rearwardly to a trailing edge, the rearward surface having a second said screening device located in or otherwise associated with it.

19. A screening device according to claim 17 wherein the rearward surface has a trailing edge at the lower end thereof which provides a blade to facilitate passage of the recovery head during reverse movement thereof.

* * * * *